US006329959B1

(12) United States Patent
Varadan et al.

(10) Patent No.: US 6,329,959 B1
(45) Date of Patent: Dec. 11, 2001

(54) TUNABLE DUAL-BAND FERROELECTRIC ANTENNA

(75) Inventors: Vijay K. Varadan, State College, PA (US); Peng Thian Teo, Singapore (SG)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/595,933

(22) Filed: Jun. 16, 2000

Related U.S. Application Data

(60) Provisional application No. 60/139,712, filed on Jun. 17, 1999.

(51) Int. Cl.[7] ..... H01Q 1/00
(52) U.S. Cl. ..... 343/787; 343/700 MS
(58) Field of Search ..... 343/700 MS, 702, 343/787, 788, 815; 501/137

(56) References Cited

U.S. PATENT DOCUMENTS

| | | | | |
|---|---|---|---|---|
| 4,162,499 | | 7/1979 | Jones, Jr. et al. | 343/700 |
| 5,427,988 | | 6/1995 | Sengupta et al. | 501/137 |
| 5,450,092 | * | 9/1995 | Das | 343/787 |
| 5,557,286 | | 9/1996 | Varadan et al. | 343/700 |
| 5,561,435 | | 10/1996 | Nalbandian et al. | 343/700 |
| 5,576,710 | | 11/1996 | Broderick et al. | 342/1 |
| 5,589,845 | | 12/1996 | Yandrofski et al. | 343/909 |
| 5,729,239 | | 3/1998 | Rao | 343/753 |
| 5,739,796 | * | 4/1998 | Jasper, Jr. et al. | 343/895 |
| 6,160,524 | * | 12/2000 | Wilber | 343/787 |

OTHER PUBLICATIONS

"Ceramic Phase Shifters for Electronically Steerable Antenna Systems" by Varadan et al., 1992, pp. 5 pages, Microwave Journal, pp. 116–126.

"Ferroelectric Materials for Phased Array Applications", IEEE Antennas & Propogation Society International Symposium, vol. 4, pp. 2284–2287, 1997.

* cited by examiner

*Primary Examiner*—Tan Ho
(74) *Attorney, Agent, or Firm*—Ohlandt, Greeley, Ruggiero & Perle, L.L.P.

(57) ABSTRACT

A multilayer tunable ferroelectric antenna assembly that includes two superimposed substrate layers. A first substrate layer consists of a low dielectric material carrying on one face an electrically ground plane, and on its opposite face an electrically conductive patch serving as an active feeder-resonator. A second substrate includes a ferroelectric material having one face positioned on top of the feeder-resonator and carrying on the opposite face an electrically conductive patch acting as a director. The upper director patch is fed through capacitve coupling of energy from the feeder-resonator. Application of bias voltage between the director and the feeder-resonator changes the permittivity of the ferroelectric substrate, thereby causing a shift in resonance frequency. A radiation null, corresponding to energy absorption, could be tuned into the resonance frequency at which the antenna is previously exhibiting a radiation characteristic. This provides the antenna a means to behave either as a radiator or an absorber at particular frequency.

20 Claims, 3 Drawing Sheets

TUNABLE DUAL-BAND FERROELECTRIC ANTENNA

This Application claims the benefit of U.S. Provisional Application No. 60/139,712, filed Jun. 17, 1999.

FIELD OF THE INVENTION

This invention relates to a dual band microstrip antenna and, more particularly, to an antenna having a tunable characteristic with the usage of ferroelectric material.

BACKGROUND OF THE INVENTION

There is a considerable demand for antennas that have a dual band performance and a tunable capability for operating in different frequency bands. For example, in wireless communications, the GSM standard used primarily in Europe has frequency bands of 890–915 MHz and 935–960MHz for the uplink and downlink, respectively. In addition to this system, the new generation of personal communication system (PCS), such as DCS 1800, has frequency bands of 1.710–1.785 GHz and 1.805–1.880 GHz for the uplink and downlink, respectively. Hence, for a portable hand-phone to be compatible with the two systems (GSM and PCS) the antenna should be able to operate in these two bands. However, communication standards vary across geographical regions. In North America, the Interim Standard-54 (IS-54) is used instead of the GSM standard. It occupies frequency bands of 869–894 MHz for the uplink and 824–849 MHz for the downlink. The antennas needed for a hand-phone that is useable in both Europe and North America will now be required to cover the three different communication standards.

The prior art suggests that this could probably be achieved with multiple antennas or a manual extractable antenna. In most cases, a single plane antenna is preferred. Most of the prior art tunable antennas use diodes or shorting pins to achieve the tuning performance. This additional circuitry adds protrusion and complexity to the antenna structure that limits the capability to operate in a compact, conformal and rugged environment.

The use of ferroelectric material in phase shifters is described in "Ceramic Phase Shifters for Electronically Steerable Antenna Systems", Varadan et al., Microwave Journal, January 1992, pages 116–126. Ferroelectric materials have also been described for use in electronic phased scanning periodic arrays. For example such arrays are described in U.S. Pat. No. 5,589,845 to Yandrofski et al., U.S. Pat. No. 5,729,239 to Rao and U.S. Pat. No. 5,557,286 to Varadan et. al. In such arrays, scanning is achieved by positioning array elements in a linear broadside arrangement. Energy coupling occurs in the horizontal azimuth plane. The common dielectric constant values for Barium Strontium Titanate materials used in the system of the Varadan et al. patent or in the system disclosed in U.S. Pat. No. 5,427,988 to Sengupta et al. are relatively high for typical antenna applications.

Microstrip antennas with high permittivity substrates have suffered from poor efficiency and narrow bandwidth. The stacking of director elements could enhance the gain and bandwidth and introduce dual band performance. U.S. Pat. No 4,162,499 to Jones, Jr. et al. and U.S. Pat. No 5,561,435 to Nalbandian et al. suggest stacking of antennas. However, the antennas of these patents are optimized at discrete frequencies only, impeding their use for frequency hopping communication systems.

Accordingly, there is a need for a technology and for a single antenna to meet multi-usage and multi-frequency requirements. There is also a need for such antennas to have a planar structure that is flexible enough to conform to hand phone or other wireless device constructions.

SUMMARY OF THE INVENTION

The present invention provides for an antenna structure that has a dual frequency band performance. Both of the resonant frequency performances are tunable to other frequency bands. For example, the dual band antenna of our invention can be tuned to the frequency bands of GMS, DCS 1800 and IS-54.

The antenna of the present invention has a stacked assembly, in which a first dielectric substrate layer is disposed on top of an electrical ground plane. A feeder radiator is disposed on top of the first dielectric substrate layer. A second substrate layer is disposed on top of the feeder-resonator. The second substrate layer is formed of a tunable ferroelectric material. An electrically conductive director patch is disposed on top of the ferroelectric material.

In accordance with the invention, the first substrate layer has a permittivity much lower than that of the second ferroelectric substrate layer. It is another feature that the feeder-resonator is designed for a lower frequency operation compared with that of the director. As a result, the feeder-resonator has very large radiating surface area.

The feeder-resonator serves two purposes: (1) to excite electromagnetic energy for the director element; and (2) to serve as a ground plane for the ferroelectric substrate and the director element. When a DC biasing voltage is applied across the ferroelectric material, the resonant frequencies of the antenna can be tuned or shifted from one frequency range to another based on the value of applied voltage.

In accordance with the invention, since the director-radiator is fed through capacitive coupling rather than direct microstrip circuitry, the need for complicated protection circuitry, such as DC blocks, against the high DC bias voltage is eliminated.

Another feature of the invention is that a radiation null is tuned in at one of the resonance frequencies, thereby transforming the antenna into an absorber of electromagnetic energy.

BRIEF DESCRIPTION OF THE DRAWING

The objects, advantages and features of the present invention will be understood by reference to the following specification in conjunction with the accompanying drawings, in which like reference characters denote like elements of structure and.

DETAILED DESCRIPTION OF THE INVENTION

Figure 1:
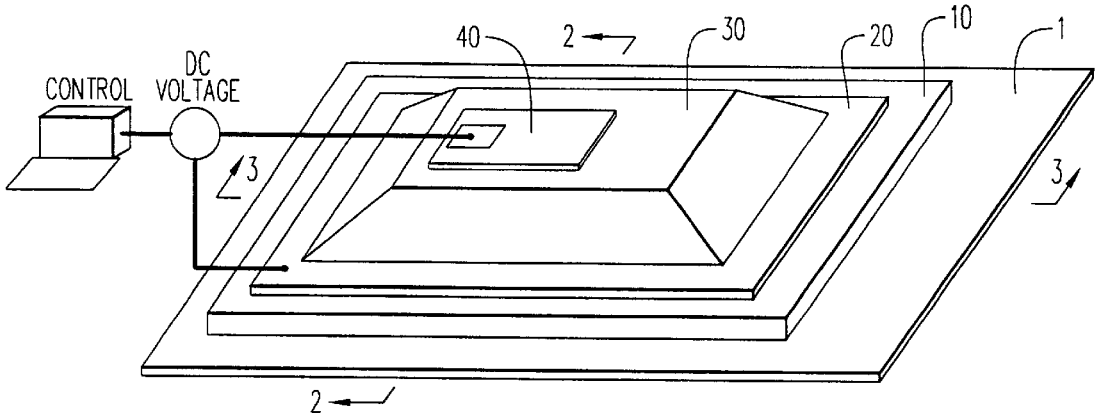
FIG. 1 is a perspective view of the antenna of the present invention.
Figure 2:
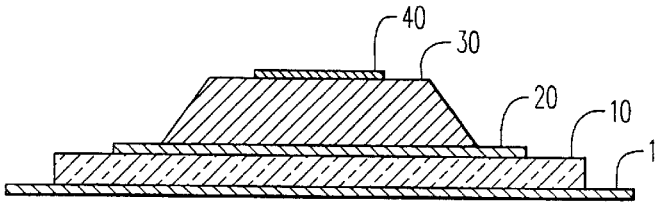
FIG. 2 is a cross sectional view, taken along line 2—2 of FIG. 1.

Referring to FIGS. 1 and 2, the tunable antenna assembly of the present invention includes a first substrate layer 10 having a low loss and low dielectric material available, for example, under the Duroid™ brand from Rogers Corporation of Chandler, Ariz. Disposed on one face of substrate layer 10 is an electrically conductive ground plane 1 and on its opposite face an electrically conductive patch serving as an active feeder-resonator 20. A second substrate 30 has one face positioned on top of feeder-resonator 20 and carrying on its opposite face an electrically conductive patch acting as a director 40. Second substrate 30 is formed of a ferroelectric material, such as barium strontium titanate or any other low loss perovskite and paraelectric films. The layers of the stacked assembly are adhered to one another by any suitable technique, such as adhesive bonding or microwave joining.

First substrate layer 10 has a permittivity value much lower than that of substrate layer 30. Moreover, feeder-resonator 20 is designed for a lower frequency operation compared with director 40. As a result, feeder-resonator 20 has a very large radiating surface area. This allows second substrate layer 30 to be positioned well within the large surface area of feeder-resonator 20.

Figure 3:
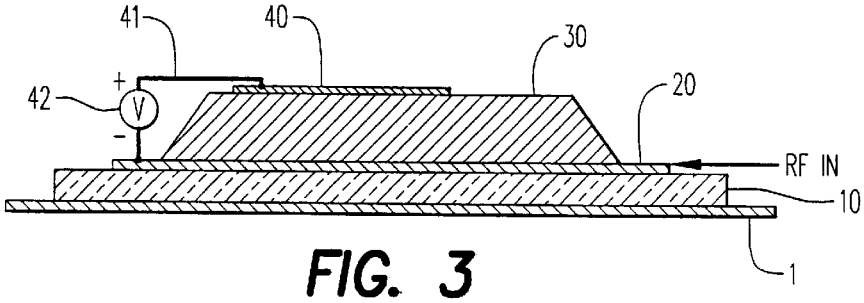
FIG. 3 is a cross sectional view, taken along the line 3—3 of FIG. 1.

Feeder-resonator 20 serves the purposes of (1) providing exciting electromagnetic energy for director 40 and (2) serving as a ground plane for ferroelectric substrate layer 30. As shown in FIGS. 1 and 3, a DC biasing voltage 42 is applied across ferroelectric substrate 30, causing a tunable performance on both its resonant frequencies. The stacking structure of ground plane 1, substrate layer 10, feeder radiator 20, second substrate layer 30 and director 40 enhances the gain of resonating director 40. A dual-band performance is also achieved through the stacking structure.

Figure 4:
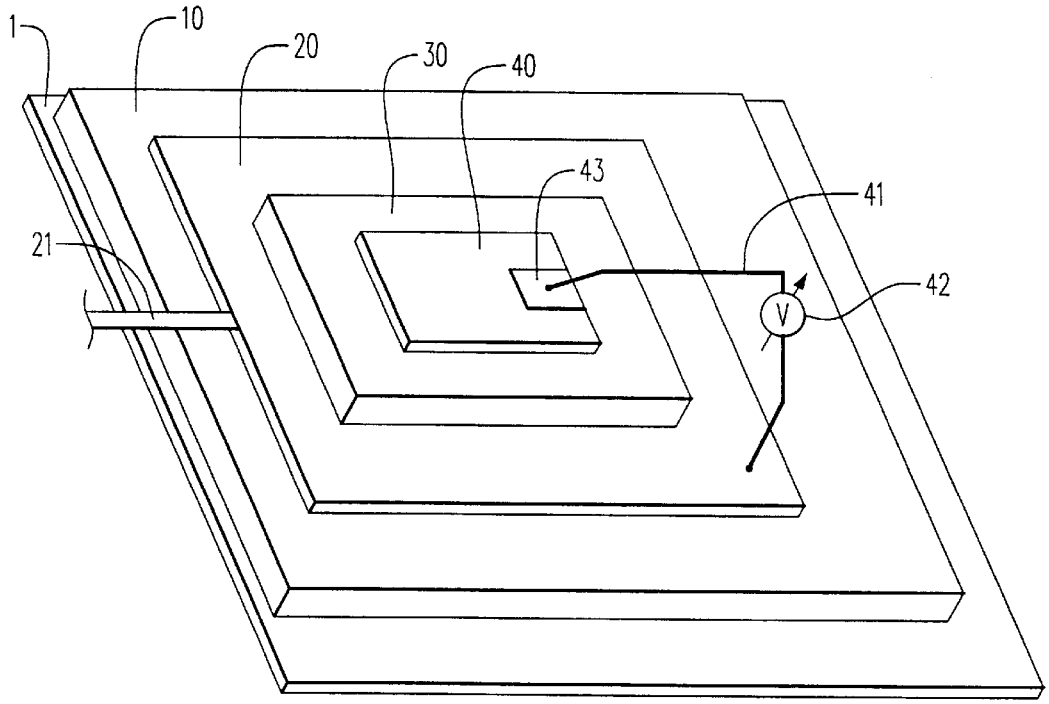
FIG. 4 is a perspective view illustrating a preferred embodiment of the invention.

Referring to FIG. 4, feeder-resonator 20 is fed by a microstrip circuit 21, while director 40 is fed by capacitive coupling of energy from feeder-resonator 20. This arrangement eliminates the need for complicated protection circuitry, such as DC blocks, against the high DC bias voltage. A DC bias pad 43 is positioned along a centerline of the director 40. A variable voltage source 42, is used to apply a bias voltage between director 40 and feeder-resonator 20, thereby changing the dielectric constant and both resonating frequencies of the antenna.

Figure 5:
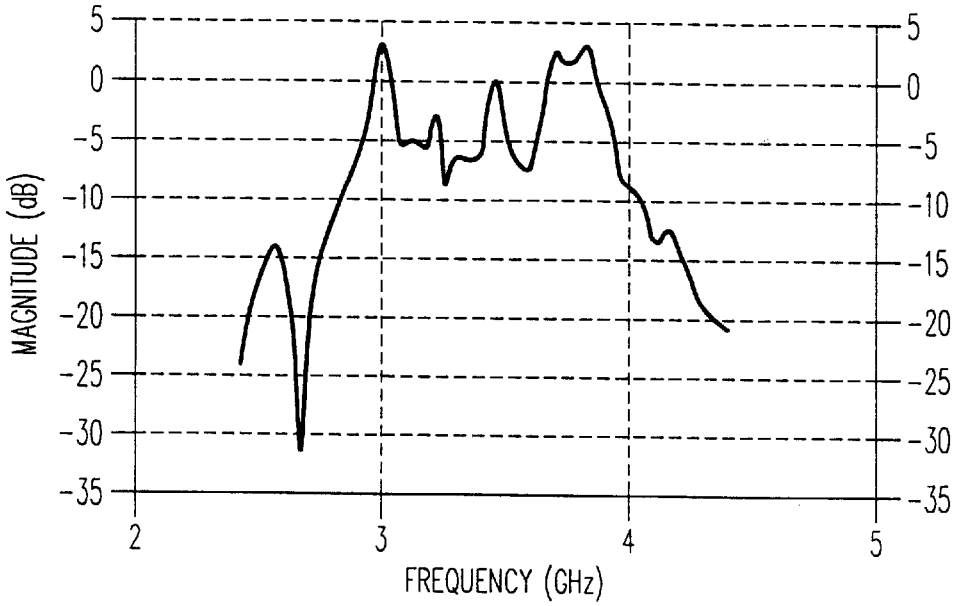
FIG. 5 is a graph showing the dual-band performance prior to tuning.
Figure 6:
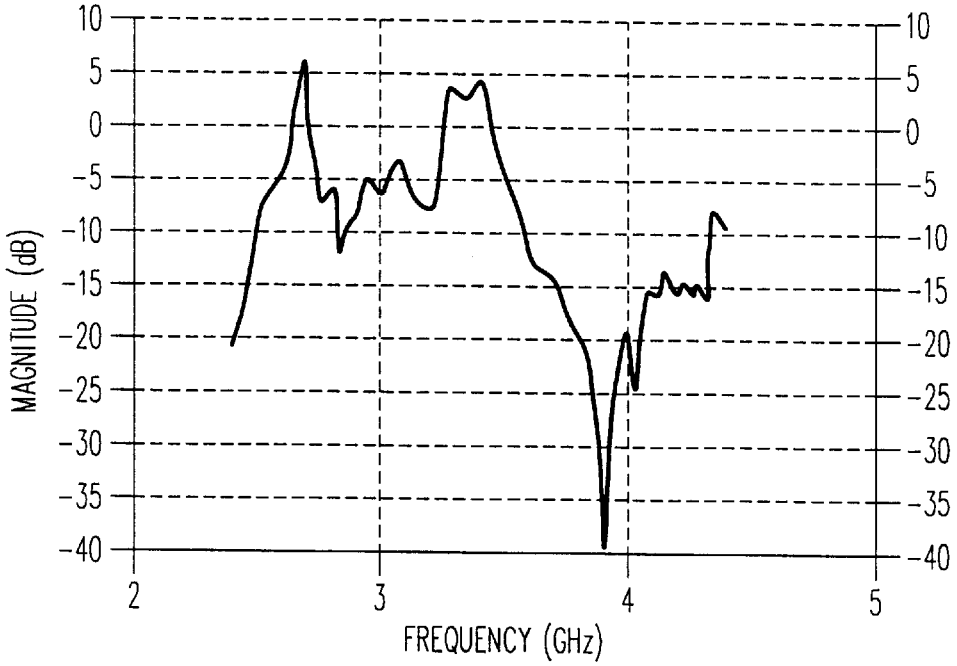
FIG. 6 is a graph showing the performance of the antenna after tuning with an applied bias voltage across the ferroelectric layer.

The dual band performance prior to any applied bias voltages is illustrated in FIG. 5. A shift in both resonant frequencies due to the applied bias voltage is observed in FIG. 6, verifying the tunability performance obtained with the ferroelectric substrate 30.

It has also been observed that a radiation null, corresponding to energy absorption, has been tuned into the upper resonance frequency at which the antenna is previously exhibiting a radiation characteristic. This provides the antenna an ability to behave either as a radiator or an absorber at this particular frequency.

The present invention having been thus described with particular reference to the preferred forms thereof, it will be obvious that various changes and modifications may be made therein without departing from the spirit and scope of the present invention as defined in the appended claims.

What is claimed is:

1. A tunable dual band antenna comprising:

a stacked assembly that includes:

a layer of ferroelectric material disposed on an electrically conductive feeder-resonator;

an electrically conductive director disposed above said layer of ferroelectric material, wherein electromagnetic energy received by said feeder-resonator is capacitively coupled via said layer of ferroelectric material to said director; and wherein said stacked assembly exhibits two resonant frequencies that are tunable in response to a bias voltage applied to said layer of ferroelectric material.

2. The tunable dual band antenna of claim 1, wherein said director is disposed on top of said layer of ferroelectric material.

3. The tunable dual band antenna of claim 2, further comprising a ground plane and a layer of dielectric material disposed between said layer of ferroelectric material and said ground plane.

4. The tunable dual band antenna of claim 3, wherein said layer of ferroelectric material has a permittivity value much higher than that of said layer of dielectric material.

5. The tunable dual band antenna of claim 4, wherein said feeder-resonator has a larger surface area compared with that of said second substrate layer of ferroelectric material and that of said director.

6. The tunable dual band antenna of claim 4, wherein said feeder-resonator acts as a ground reference for said layer of ferroelectric material and said director when a DC biasing voltage is applied to said layer of ferroelectric material.

7. The tunable dual band antenna of claim 6, further comprising means for applying said bias voltage across said layer of ferroelectric material to tune said antenna, and wherein said bias voltage is variable.

8. The tunable dual band antenna of claim 7, wherein said bias voltage is variable.

9. The tunable dual band antenna of claim 4, wherein said ferroelectric material includes barium strontium titanate.

10. A method for transforming an antenna into an absorber for electromagnetic energy at a particular frequency comprising the steps of.

providing a layer of ferroelectric material disposed on a feeder-resonator;

providing a director-resonator disposed above said layer of ferroelectric material; and providing a bias voltage across said layer of ferroelectric material.

11. The method of claim 10, further comprising:

providing an electrically conductive ground plane; and providing a layer of low dielectric material between said layer of ferroelectric material and said ground plane.

12. The method of claim 11, wherein said layer of ferroelectric material has a permittivity value much higher than that of said layer of dielectric material.

13. The method of claim 12, further comprising providing a resistive layer defining a predetermined broken pattern above said director resonator.

14. The method of claim 13, wherein the bias voltage is varied until a radiation null is generated or tuned into a resonance frequency at which the antenna previously exhibited a radiation.

15. A tunable dual band antenna assembly comprising:

an electrically conductive ground plane;

a first substrate layer having a bottom surface overlying said ground plane and an opposing upper surface, wherein said first substrate layer includes a low dielectric material;

an electrically conductive sheet overlying said opposing upper surface of said substrate layer; said electrically conductive sheet including a patch radiator and a microstrip feed therefor; wherein said patch radiator serves as a feeder radiator;

a second substrate layer having one face positioned on top of said feeder radiator and an opposing face, said second substrate layer including a thin film ferroelectric material having a permittivity value much higher than that of said first substrate layer;

an electrically conductive patch overlying said opposing face of said second substrate layer, wherein said electrically conductive patch is operable as a director and is fed through capacitive coupling of energy from said patch radiator; and means for applying a bias voltage across said second substrate layer.

16. The tunable dual band antenna assembly of claim 15, wherein said feeder radiator has a larger surface area compared with that of said thin-film ferroelectric substrate layer and said director, wherein said feeder radiator and said director are dimensioned for different frequencies.

17. The tunable dual band antenna assembly of claim 15, wherein said feeder radiator is operable to excite electromagnetic energy for said director element and to serve as a ground plane for said second substrate layer and said director.

18. The tunable dual band antenna assembly of claim 15, wherein said bias voltage is variable to tune said antenna.

19. A method for providing adaptive nulling at a particular frequency in a radiation pattern of an antenna comprising the steps of:

providing an electrically conductive ground plane;

providing a first substrate layer of dielectric material over the ground plane;

providing a first electrically conductive sheet overlying a top of said first substrate layer, wherein said first electrically conductive sheet includes a feeder patch resonator and a microstrip feed therefor;

providing a second substrate layer over said feeder patch resonator, wherein said second substrate layer inclues a tunable thin-film ferroelectric material;

providing a second electrically conductive sheet overlying a top of said second substrate layer, wherein said second electrically conductive sheet includes a director-patch resonator;

providing a bias voltage between said second electrically conductive sheet and said firt electrically conductive sheet; and providing a resistive layer defining a predetermined broken pattern thereon over said director-patch resonator.

20. The method of claim 19, wherein said bias voltage is varied until a radiation null is generated or turned into a resonance frequency at which the antenna previously exhibiting a radiation.

* * * * *